US009190764B2

(12) United States Patent
Hamner et al.

(10) Patent No.: US 9,190,764 B2
(45) Date of Patent: Nov. 17, 2015

(54) ELECTRICAL CONNECTOR HAVING AN ARRAY OF SIGNAL CONTACTS

(71) Applicant: Tyco Electronics Corporation, Berwyn, PA (US)

(72) Inventors: Richard Elof Hamner, Hummelstown, PA (US); Christopher David Ritter, Hummelstown, PA (US); Justin Shane McClellan, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 146 days.

(21) Appl. No.: 14/052,051

(22) Filed: Oct. 11, 2013

(65) Prior Publication Data

US 2015/0104978 A1 Apr. 16, 2015

(51) Int. Cl.

| | |
|---|---|
| ***H01R 13/648*** | (2006.01) |
| ***H01R 13/514*** | (2006.01) |
| ***H01R 13/6587*** | (2011.01) |
| *H01R 12/71* | (2011.01) |
| *H01R 12/72* | (2011.01) |
| *H01R 12/73* | (2011.01) |

(52) U.S. Cl.

CPC ..... *H01R 13/514* (2013.01); *H01R 13/6587* (2013.01); *H01R 12/716* (2013.01); *H01R 12/727* (2013.01); *H01R 12/737* (2013.01)

(58) Field of Classification Search

CPC ..... H01R 23/688
USPC ..... 439/607.07, 607.06
See application file for complete search history.

(56) References Cited

U.S. PATENT DOCUMENTS

| | | | | |
|---|---|---|---|---|
| 4,568,136 | A * | 2/1986 | Reuss | 439/629 |
| 6,345,990 | B1 * | 2/2002 | Hyzin | 439/79 |
| 8,485,831 | B2 * | 7/2013 | Cipolla et al. | 439/74 |

* cited by examiner

*Primary Examiner* — Phuong Dinh

(57) ABSTRACT

Electrical connector including a connector body having a mating side with a communication array of signal and ground contacts and first and second mounting sides with respective mounting arrays of signal and ground contacts. Each of the first and second mounting sides is configured to be mounted to a corresponding circuit board. The connector body includes signal and ground conductors that extend through the connector body and communicatively couple the communication array to each of the mounting arrays. The mating side faces along a mating axis and the first and second mounting sides face in opposite directions along a mounting axis. The mating and mounting axes are perpendicular to each other.

19 Claims, 8 Drawing Sheets

ELECTRICAL CONNECTOR HAVING AN ARRAY OF SIGNAL CONTACTS

BACKGROUND

The subject matter herein relates generally to electrical connectors that are configured to transmit data signals.

Electrical connectors may be used within communication systems, such as telecommunication equipment, servers, data storage, transport devices, and the like. Some communication systems include daughter card assemblies, which may be communicatively coupled to each other through a backplane (or midplane) assembly. Each of the daughter card assemblies includes a receptacle connector that is mounted to a circuit board, which is referred to as a daughter card. The backplane assembly includes header connectors that are mounted to the backplane (or midplane) circuit board. Each of the receptacle connectors of the daughter card assemblies mates with a different one of the header connectors thereby communicatively coupling the daughter card assemblies to the backplane assembly.

The receptacle connector includes a mating side that engages the backplane assembly and a mounting side that is mounted to the corresponding circuit board. The mating and mounting sides typically face in directions that are perpendicular to each other. In many connectors, the mating and mounting sides have a dense array of contacts that include signal contacts and ground contacts.

The daughter card to which the receptacle connector is mounted includes an array of plated thru-holes that receive the signal and ground contacts of the receptacle connector. The plated thru-holes that receive the signal contacts are electrically connected to signal traces of the circuit board. Many circuit boards include multiple signal layers in which each signal layer has a number of signal traces. The signal traces of different layers are joined through vias in the layers. Accordingly, a signal propagating along a signal pathway in the circuit board may encounter a number of interfaces where the vias of signal layers electrically join different signal traces. Generally, increasing the number of such interfaces along the signal pathway increases signal degradation (or loss in signal quality).

One ongoing trend in electrical connectors, including the receptacle connectors discussed above, is the increased density of signal pathways through the electrical connector. Greater densities permit smaller devices and/or enable greater data throughput. To accommodate the greater density of signal pathways in the receptacle connectors, the circuit boards to which the receptacle connectors are mounted have been modified. For example, signal layers have been added to the circuit boards to provide more space for routing the signal pathways to or from the plated thru-holes. As discussed above, however, additional signal layers correspond to more interfaces that are encountered by the propagating signal, which can negatively affect signal quality. Increasing the number of layers also increases the cost of the circuit board.

In addition to the above, one drawback with conventional daughter card assemblies is that the receptacle connectors have a fixed geometry that provides only a single mounting array that is mounted to a single daughter card. Receptacle connectors capable of mounting to multiple daughter cards, in addition to coupling to the header connector, may be desired. For example, a receptacle connector with two mounting arrays could be mounted to two daughter cards. Such receptacle connectors could possibly reduce the contact densities of the mounting arrays so that thinner daughter cards may be used while also maintaining the overall throughput of the receptacle connector.

Accordingly, there is a need for an electrical connector having multiple mounting arrays that is capable of being communicatively coupled to three circuit boards.

BRIEF DESCRIPTION

In one embodiment, an electrical connector is provided that includes a connector body having a mating side with a communication array of signal and ground contacts and first and second mounting sides with respective mounting arrays of signal and ground contacts. Each of the first and second mounting sides is configured to be mounted to a corresponding circuit board. The connector body also includes signal and ground conductors that extend through the connector body and communicatively couple the communication array to each of the mounting arrays. The mating side faces along a mating axis and the first and second mounting sides face in opposite directions along a mounting axis. The mating and mounting axes are perpendicular to each other.

In some embodiments, the connector body includes a module assembly having a series of distinct contact modules coupled to one another. The series of contact modules collectively form the mating side and the first and second mounting sides. Optionally, each of the contact modules includes a mating edge and a mounting edge that extend perpendicular to each other. The series of contact modules may include first and second contact modules. The mounting edge of the first contact module may include at least some of the signal and ground contacts of the first mounting array, and the mounting edge of the second contact module may include at least some of the signal and ground contacts of the second mounting array.

In another embodiment, an electrical connector is provided that includes a module assembly having a plurality of discrete contact modules with respective module bodies that are coupled directly or indirectly to one another. Each of the module bodies has a mating edge and a mounting edge that extend substantially perpendicular to each other. Each of the contact modules also has signal contacts disposed along the mating and mounting edges and signal conductors that extend between the mating and mounting edges to join corresponding signal contacts. The mating edges of the contact modules face in a common mating direction such that the signal contacts along the mating edges collectively form a communication array. The mounting edges of at least two of the contact modules face in opposite mounting directions.

In some embodiments, the electrical connector may include a connector shroud that is coupled to the module assembly and interfaces with the communication array. Optionally, each of the contact modules is oriented with respect to a central module axis. The mating edges for each of the contact modules face along the respective module axes. The connector shroud includes a plurality of module-securing features. Each of the contact modules also includes a plurality of shroud-securing features that directly engage corresponding module-securing features of the connector shroud. The shroud-securing features for each of the contact modules having a rotational symmetry such that an operative configuration of the shroud-securing features for each of the contact modules is substantially identical before and after the corresponding contact module is rotated 180° about the corresponding module axis.

In some embodiments, the contact modules may include first and second contact modules. The module body of the first contact module may have a side surface that includes a reference element, and the module body of the second contact module may have a side surface that includes a reference element. The reference elements of the first and second contact modules may engage each other to position the first and second contact modules in a designated orientation with respect to each other.

DETAILED DESCRIPTION

Figure 1:
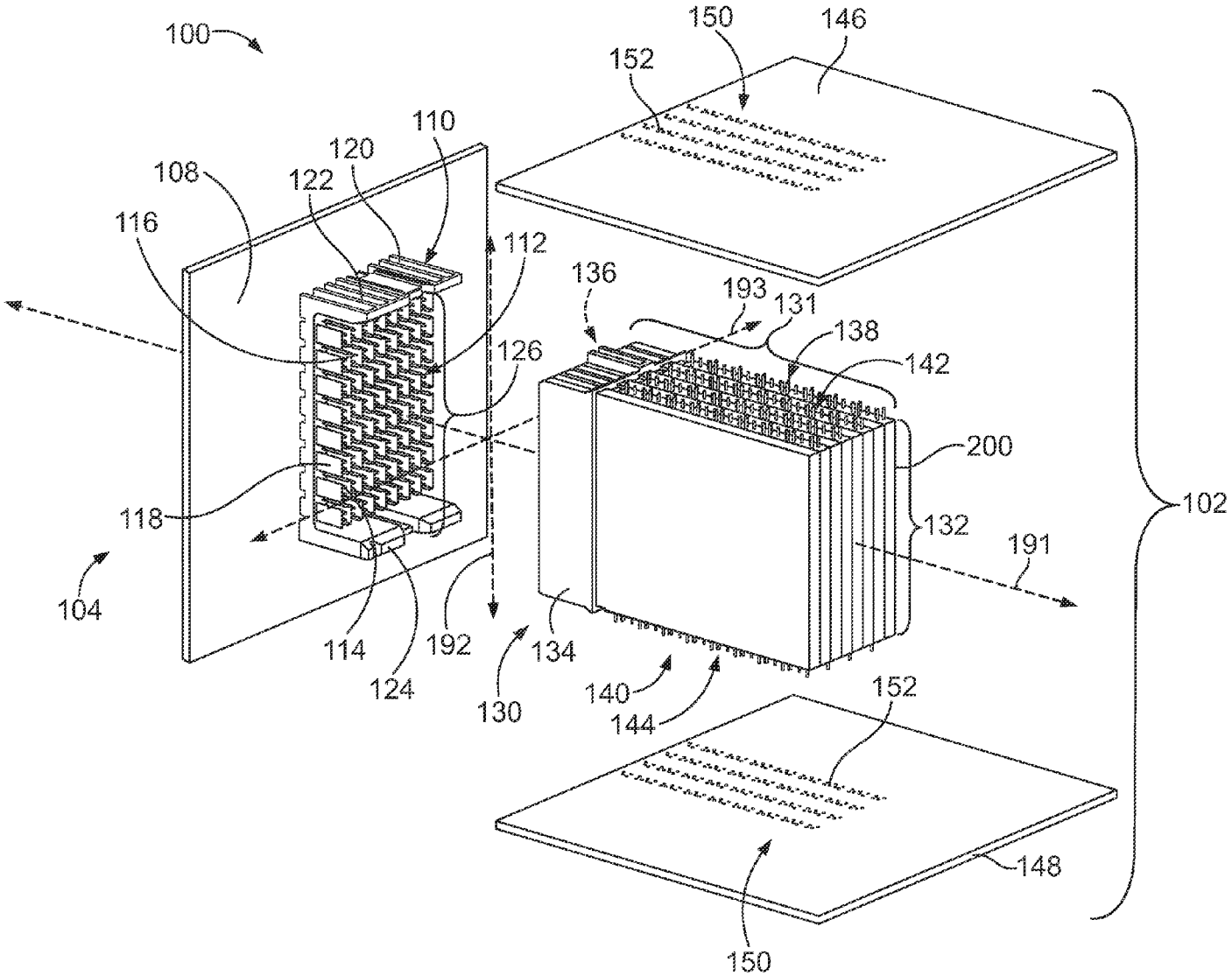
FIG. 1 is an exploded perspective view of a communication system formed in accordance with one embodiment.

Embodiments described herein include communication systems that are configured to transmit data signals and electrical connectors and assemblies of such systems. The electrical connectors may include signal contacts and, optionally, ground contacts that are positioned relative to one another to form multiple contact arrays. The multiple contact arrays may be communicatively coupled to one another. The contact arrays may be referred to as communication arrays or mounting arrays. For instance, embodiments described herein may include electrical connectors having a communication array and two mounting arrays. The mounting arrays may be mounted to respective circuit boards, and the communication array may engage another connector that can be mounted to another circuit board. Alternatively, the communication array may be mounted directly to the circuit board. The mounting arrays may each be communicatively coupled to the communication array through the electrical connector.

In some embodiments, the contact arrays are two-dimensional arrays in which the contacts form multiple rows and columns of contacts. In alternative embodiments, however, the contact arrays may have only a single row or column of contacts. In certain embodiments, the communication arrays may be high density arrays such that the communication array has at least 12 signal contacts per 100 $mm^2$ or at least 20 signal contacts per 100 $mm^2$.

The electrical connectors may be, for example, receptacle connectors of a daughter card assembly or header connectors of a backplane assembly. The communication systems and the electrical connectors set forth herein may be configured for high-speed differential signal transmission, such as 10 Gbps, 20 Gbps, or more. Moreover, the electrical connectors may be configured to have designated characteristic impedances, such as 85 ohm or 100 ohm. However, it is understood that the electrical connectors described herein may be used in other applications that are not backplane systems or that are not high-speed signal transmission systems.

The electrical connectors set forth herein may be capable of communicatively coupling a first circuit board to second and third circuit boards. For example, the first circuit board may be a backplane or mid-plane circuit board and the second and third circuit boards may be daughter cards. In some embodiments, the second and third circuit boards may extend parallel to and oppose each other with a space therebetween. The electrical connector may be positioned within the space and sandwiched between the first and second circuit boards while engaged to the first circuit board. In such embodiments, the connector assembly may be referred to as a dual-card assembly or the communication system may be referred to as a tri-card system.

In particular embodiments, the electrical connector includes a module assembly having a plurality of contact modules with selected rotational positions. Each of the contact modules may have a mounting edge that includes signal and ground contacts that engage one of the circuit boards. The contact modules may be oriented such that one or more of the contact modules engages the first circuit board and one or more contact modules engages the second circuit board. In particular, the contact modules described herein may have attachment features that are positioned to have a rotational symmetry for coupling to a connector shroud. As used herein, the term "rotational symmetry" refers to the contact module having an identical arrangement or configuration of the attachment features whether in a first rotational position or in a second rotational position. As such, the contact module may couple to the connector shroud in each of the first and second rotational positions. The attachment features may include physically-defined structures that directly engage other physically-defined structures of the connector shroud. For example, the attachment features may be projections or surfaces that define cavities for receiving projections. The attachment features may also be latches.

FIG. 1 shows an exploded perspective view of a communication system 100 that includes a first circuit board assembly 102 and a second circuit board assembly 104. For reference, the circuit board assemblies 102, 104 are arranged with respect to mutually perpendicular axes 191-193, including a central mating axis 191, a mounting axis 192, and a lateral axis 193. During a mating operation, the circuit board assembly 102 may be advanced along the mating axis 191 toward the circuit board assembly 104. In the illustrated embodiment, the second circuit board assembly 104 is a backplane assembly, and the first circuit board assembly 102 is a daughter card assembly configured to directly engage the backplane assembly. Embodiments set forth herein, however, are not limited to backplane (or midplane) applications.

The circuit board assembly 104 includes a circuit board 108 and an electrical connector 110 mounted to the circuit board 108. The circuit board 108 may be, for example, a mother board. The electrical connector 110 may be referred to as a mating connector or header connector. The electrical connector 110 has a contact array (or header array) 112 of electrical contacts that include signal contacts 114 and ground contacts 116. In FIG. 1, the signal contacts 114 are arranged in pairs in which each signal pair is surrounded by a respective ground contact 116. The signal contacts 114 may be configured to transmit data signals, such as differential signals, and the ground contacts 116 may be configured to electrically shield the signal contacts 114. For example, each of the ground contacts 116 may be C-shaped or L-shaped and surround a single pair of the signal contacts 114. In the illustrated embodiment, the contact array 112 also includes ground shields or walls 118. The ground shields 118 are arranged along an outer column of the contact array 112 and may also be configured to electrically shield corresponding signal contacts 114.

The electrical connector 110 also includes a connector housing 120. As shown, the connector housing 120 includes a pair of sidewalls 122, 124 that define a connector-receiving space 126 therebetween. The sidewalls 122, 124 oppose each other and are spaced apart from each other along the mounting axis 192. The contact array 112 is located within the connector-receiving space 126. The connector housing 120 may have other configurations in alternative embodiments. For example, in one alternative embodiment, the connector housing 120 may include another pair of sidewalls that are spaced apart from each other along the lateral axis 193.

The connector assembly 102 includes an electrical connector 130, which may also be referred to as a receptacle connector. In some embodiments, the electrical connector 130 includes a module assembly 132 and a connector shroud or housing 134 that is coupled to the module assembly 132. For example, the module assembly 132 may include a series of discrete or distinct contact modules 200 that are stacked side-by-side when the module assembly 132 is assembled. The contact modules 200 may be coupled to one another directly or indirectly. For example, the contact modules 200 may be coupled to the connector shroud 134 such that the contact modules 200 are indirectly coupled to one another by the connector shroud 134. In other embodiments, side features (not shown) of the contact modules 200 may directly engage each other to hold the contact modules 200 side-by-side.

In some embodiments, the module assembly 132 and the connector shroud 134 may be referred to collectively as a connector body 131 of the electrical connector 130. As shown, the connector body 131 includes separable components, such as the connector shroud 134 and the module assembly 132. However, in other embodiments, one or more components may be combined. For instance, the module assembly 132 may include features that are similar to the features of the connector shroud 134 as described herein. In such embodiments, a separate connector shroud may not be required. As another example, in the illustrated embodiment, the module assembly 132 includes discrete contact modules 200. In other embodiments, however, the module assembly may be a single structure that includes similar features as the multiple contact modules described herein.

The connector shroud 134 is configured to be inserted into the connector-receiving space 126 and mate with the connector housing 120. The electrical connector 130 includes a mating side 136 and mounting sides 138, 140. The mating side 136 may include a portion of the connector shroud 134 that faces the electrical connector 110 along the mating axis 191. In alternative embodiments that do not utilize a connector shroud, the module assembly 132 may include the mating side 136. The mounting sides 138, 140 face in opposite mounting directions along the mounting axis 192.

Each of the mating side 136 and the mounting sides 138, 140 has a corresponding contact array that includes signal contacts and ground contacts disposed along the corresponding side of the connector body 131. For example, the mating side 136 includes a communication array 139 (shown in FIG. 5) that engages the contact array 112. More specifically, the signal contacts 114 of the contact array 112 may directly engage signal contacts 206 (shown in FIG. 3) of the communication array 139 and the ground contacts 116 of the contact array 112 may directly engage ground contacts 216 (shown in FIG. 3) of the communication array 139. The mounting sides 138, 140 also include mounting arrays 142, 144, respectively, which may have respective signal and ground contacts as described below.

The connector assembly 102 also includes a pair of circuit boards (or daughter cards) 146, 148. The circuit boards 146, 148 are configured to engage the mounting sides 138, 140, respectively. More specifically, each of the circuit boards 146, 148 includes a board array 150 of plated thru-holes (PTHs) 152. The PTHs 152 are arranged to receive respective contacts of the mounting arrays 142, 144.

Figure 2:
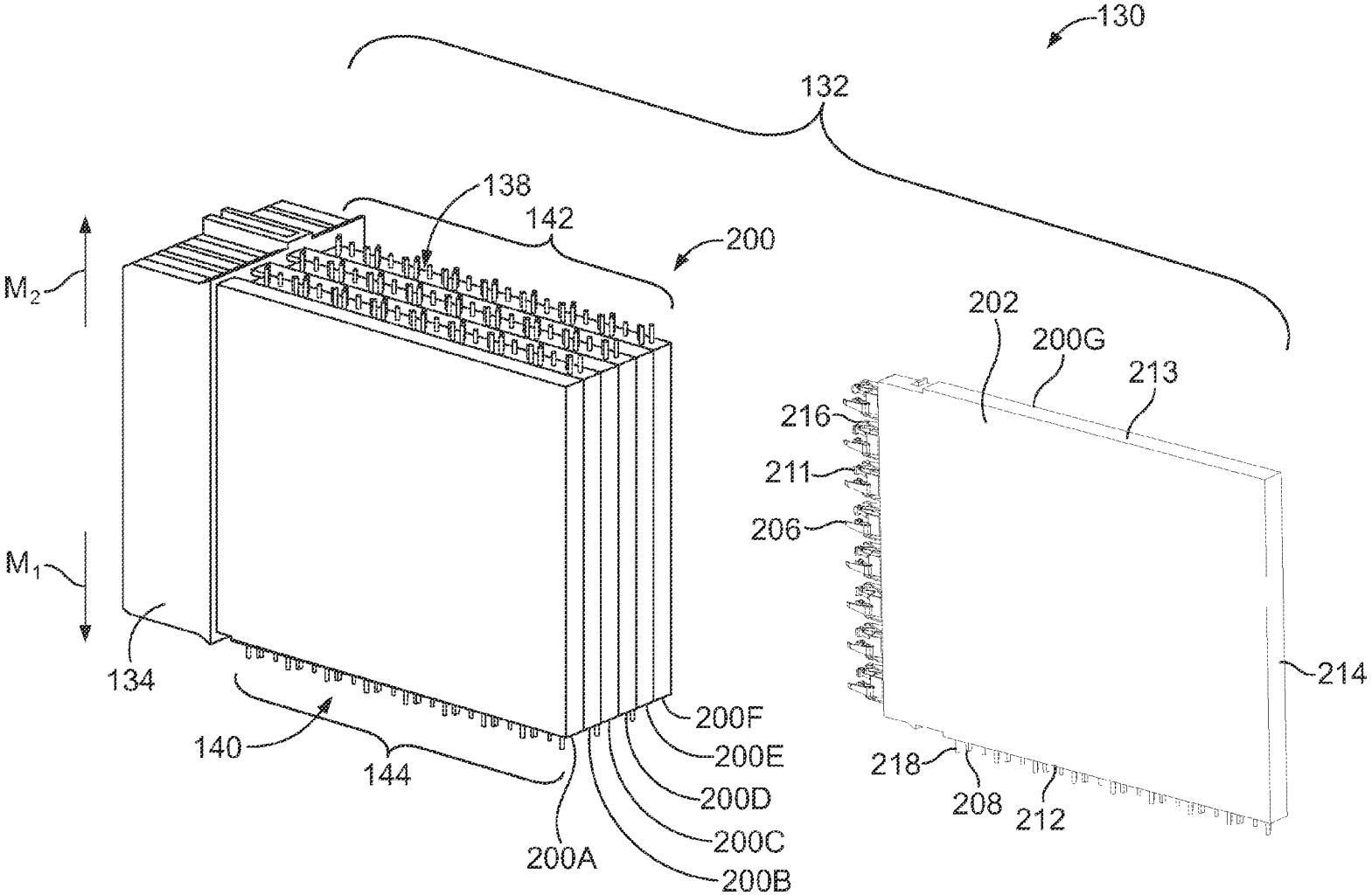
FIG. 2 is a partially exploded view of an electrical connector formed in accordance with one embodiment that may be used with the communication system of FIG. 1.

FIG. 2 is a partially-exploded view of the electrical connector 130. The module assembly 132 includes a plurality of the contact modules 200, which are individually referenced as contact modules 200A-200G. Although not shown in FIG. 2, the module assembly 132 also includes a contact module 200H (shown in FIG. 5). Each of the contact modules 200A-200H is configured to be coupled to the connector shroud 134. In FIG. 2, the connector shroud 134 is coupled to the contact modules 200A-200F and is positioned to receive the contact module 200G and the contact module 200H.

Figure 5:
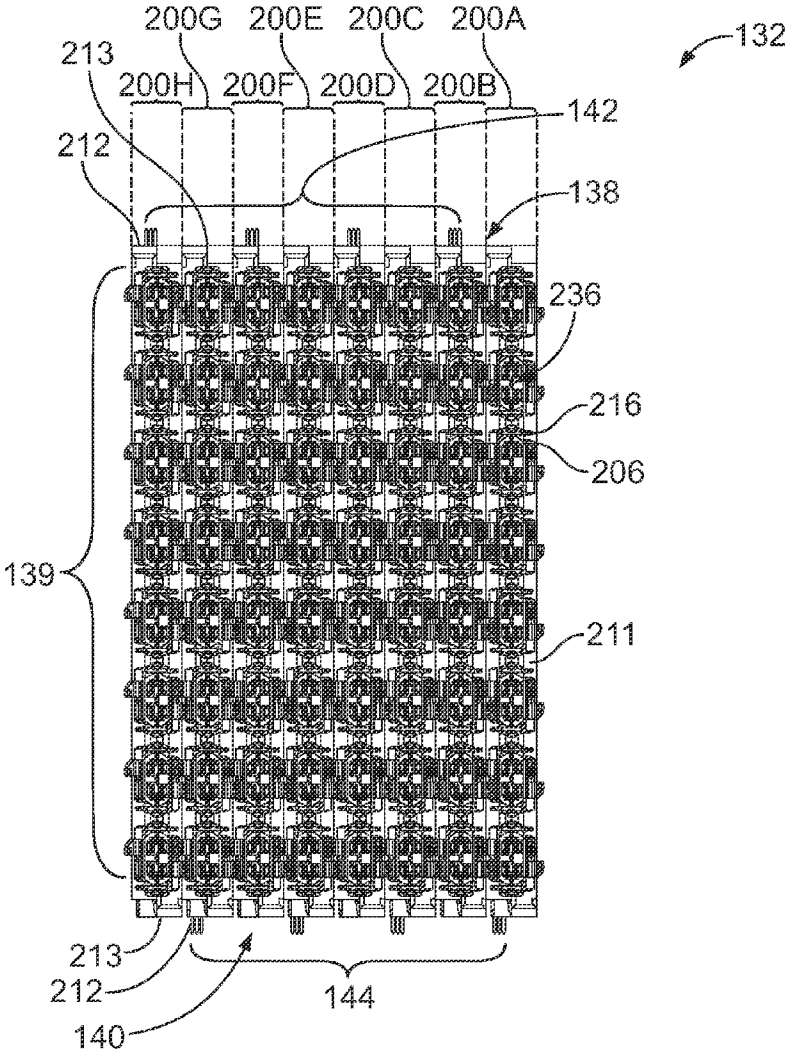
FIG. 5 is a front-end view of a module assembly that includes a plurality of the contact modules.

Although the following is with specific reference to the contact module 200G, each of the other contact modules 200A-200F and 200H may include similar features. As shown, the contact module 200G includes a module body 202 having a plurality of edges 211-214, which include a mating edge 211, a mounting edge 212, a module or non-mounting edge 213, and a module or rear edge 214. The contact module 200G also includes a plurality of signal contacts 206 disposed along the mating edge 211 and a plurality of signal contacts 208 disposed along the mounting edge 212. The signal contacts 206 will form a portion of the communication array 139 (FIG. 5). Because of the rotational position of the contact module 200G in FIG. 2, the signal contacts 208 will form a portion of the mounting array 144. In the illustrated embodiment, the contact module 200G also has a plurality of ground contacts 216 disposed along the mating edge 211 and a plurality of ground contacts 218 disposed along the mounting edge 212. Likewise, the ground contacts 216 will form a portion of the communication array 139, and the ground contacts 218 will form a portion of the mounting array 144.

As shown in FIG. 2, the contact modules 200A-200G have different orientations. As set forth herein, the contact modules 200A-200G may be selectively positioned or oriented to form the mounting arrays 142, 144. For example, in the illustrated embodiment, the contact modules 200A-200G have alternating orientations such that each of the contact modules 200A-200G has a different orientation than an adjacent contact module(s). More specifically, the contact modules 200A, 200C, 200E, and 200G have a first rotational position such that the respective mounting edges 212 face in a first mounting direction $M_1$, and the contact modules 200B, 200D, and 200F have a second rotational position such that the respective mounting edges 212 face in a second mounting direction $M_2$. When the communication system 100 (FIG. 1) is fully assembled, the mounting directions $M_1$ and $M_2$ are in opposite directions along the mounting axis 192 (FIG. 1).

The mounting edges 212 of the contact modules that have the same rotational position face in a common direction to form one of the mounting sides with the non-mounting edges 213 of the other contact modules. For example, the mounting edges 212 of the contact modules 200A, 200C, 200E, and 200G and the non-mounting edges 213 of the contact modules 200B, 200D, 200F, and 200H collectively form the mounting side 140. The signal and ground contacts 208, 218 of the contact modules 200A, 200C, 200E, and 200G collectively form the mounting array 144. The mounting edges 212 of the contact modules 200B, 200D, 200F, and 200H and the non-mounting edges 213 of the contact modules 200A, 200C, 200E, and 200G collectively form the mounting side 138. The signal and ground contacts 208, 218 of the contact modules 200B, 200D, 200F, and 200H collectively form the mounting array 142. Regardless of the rotational position of the contact module, however, the signal and ground contacts 206, 216 of the contact modules 200A-200H collectively form the communication array 139. Thus, in the illustrated embodiment, half of the signal contacts 206 are communicatively coupled to the mounting array 142 and the other half of the signal contacts 206 are communicatively coupled to the mounting array 144.

Figure 3:
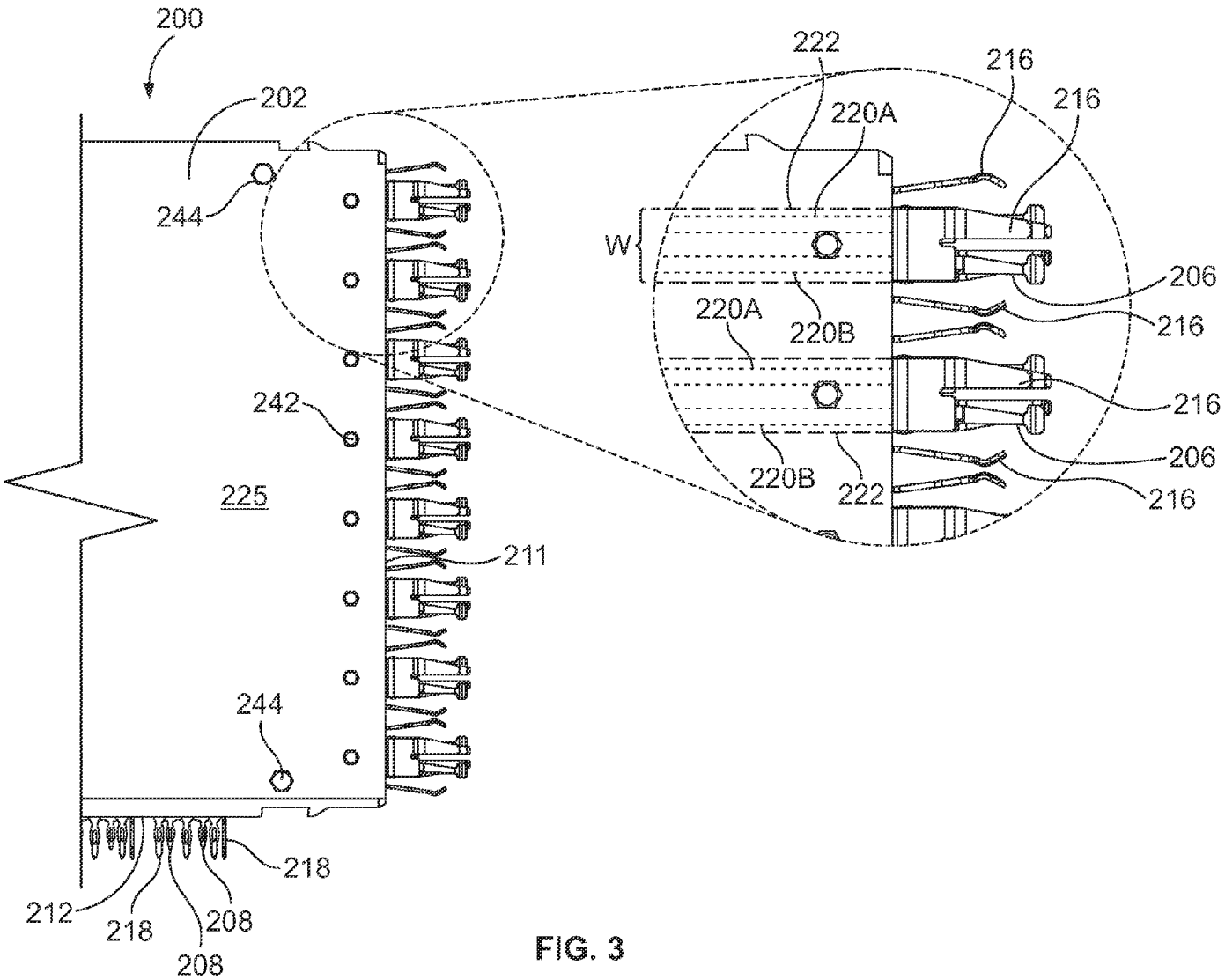
FIG. 3 is an enlarged side view of a contact module that may be used with the electrical connector of FIG. 2.

FIG. 3 is an enlarged side view of one exemplary contact module 200. In the illustrated embodiment, the signal contacts 206 and the ground contacts 216 along the mating edge 211 are contact beams capable of resiliently flexing between different positions. As described in greater detail below, the ground contacts 216 are positioned to surround the signal contacts 206. The signal contacts 208 and the ground contacts 218 along the mounting edge 212 may be conductor tails that are configured to be inserted into corresponding PTHs 152 (FIG. 1).

As indicated in the enlarged portion of FIG. 3, the contact module 200 includes a plurality of signal conductors 220A, 220B (indicated by dashed lines) that extend through the module body 202. Each of the signal conductors 220A, 220B is terminated by one of the signal contacts 206 and one of the signal contacts 208. In particular embodiments, the signal conductors 220A, 220B are continuous strips of conductive material that include the corresponding signal contacts 206, 208. For example, the signal conductors 220A, 220B may be stamped and/or etched from a common sheet of material to form a lead frame. The ends of these strips may be shaped to form the signal contacts 206, 208. As shown, the signal conductors 220A, 220B are arranged in pairs in which the signal conductors 220A, 220B of each pair extend adjacent and parallel to each other through the module body 202.

In a similar manner, the contact module 200 may have a plurality of ground conductors 222 (also indicated by dashed lines in the enlarged portion of FIG. 3) that extend through the module body 202. In some embodiments, the ground conductors 222 are sized and shaped to extend along a single pair of the signal conductors 220A, 220B. For example, the ground conductor 222 has a width W that is greater than the combined width of both of the signal conductors 220A, 220B in one pair. The ground conductors 222 are terminated by at least one of the ground contacts 216 and at least one of the ground contacts 218. In the illustrated embodiment, each of the ground conductors 222 includes a plurality of the ground contacts 216 and a plurality of the ground contacts 218. In some embodiments, the ground conductors 222 are electrically common. More specifically, the ground conductors 222 may be electrically connected to one another.

The signal conductors 220A, 220B and the ground conductors 222 extend within the module body 202 between the mating and mounting edges 211, 212. As shown in FIG. 3, the contact module 200 has a right-angle configuration such that the mating edge 211 and the mounting edge 212 extend substantially perpendicular to each other. For each contact module 200, the mating edge 211 includes a column of signal contacts 206 and ground contacts 216 that are configured to engage respective signal and ground contacts 114, 116 (FIG. 1) of the electrical connector 110 (FIG. 1). Similarly, the mounting edge 212 includes a column of signal contacts 208 and ground contacts 218 that are configured to engage respective PTHs 152 (FIG. 1).

Also shown in FIG. 3, the module body 202 has a side surface 225 that includes a plurality of reference elements 242 and a plurality of reference elements 244. In the illustrated embodiment, the reference elements 242 are distributed along and proximate to the mating edge 211. The reference elements 242, 244 may be physical features of the module body 202, such as projections or recesses. In other embodiments, the reference elements 242, 244 may be separate components that are coupled to the module body 202, such as rods or posts. As described below, the reference elements 242, 244 may be configured to orient the contact modules 200 when the contact modules 200 are stacked side-by-side. In the illustrated embodiment, the reference elements 242 are dimensioned to be larger than the reference elements 242, but other sizes and shapes may be used.

Figure 4:
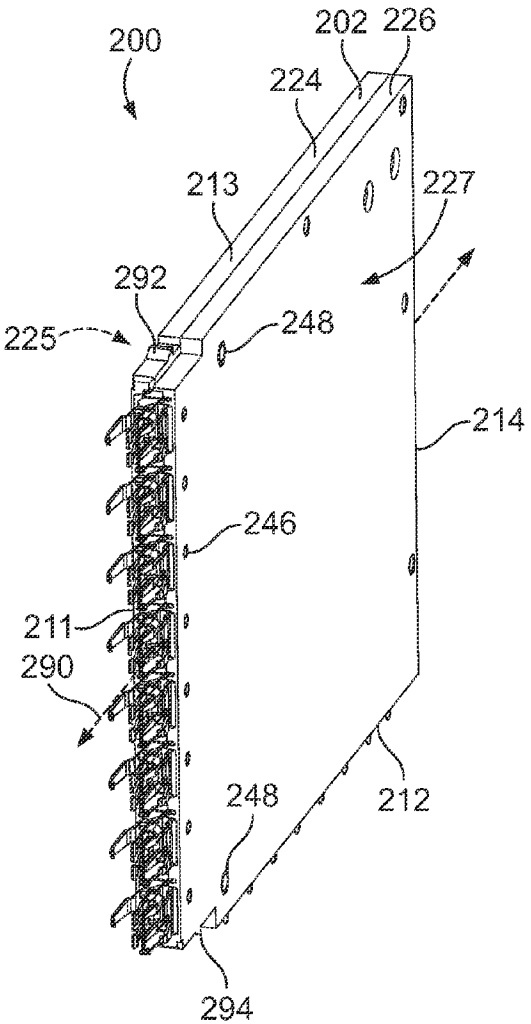
FIG. 4 is an isolated perspective view of the contact module that may be used with the electrical connector of FIG. 2.

FIG. 4 is an isolated perspective view of the contact module 200. In the illustrated embodiment, the module body 202 is formed from a first housing shell 224 and a second housing shell 226. The housing shells 224, 226 may be coupled to each other with the signal conductors 220A, 220B (FIG. 3) and ground conductors 222 (FIG. 3) sandwiched therebetween. The housing shell 224 may define the first side surface 225 of the contact module 200, and the housing shell 226 may define a second side surface 227 of the contact module 200. The side surfaces 225, 227 face in opposite directions.

The housing shells 224, 226 have shroud-securing features 292, 294, respectively. The shroud-securing features 292, 294 are configured to couple the contact module 200 to the connector shroud 134 (FIG. 1). In the illustrated embodiment, the shroud-securing features 292, 294 are projections that extend away from the non-mounting edge 213 and the mounting edge 212, respectively, and are located proximate to the mating edge 211. However, the shroud-securing features 292, 294 may have different dimensions and locations in other embodiments. For example, the shroud-securing features 292, 294 may be surfaces of the module body 202 that form recesses configured to receive projections. In other embodiments, the shroud-securing features 292, 294 may be tabs or latches configured to couple to the connector shroud 134.

The shroud-securing features 292, 294 may be located with respect to a central module axis 290 so that the shroud-securing features 292, 294 have a rotational symmetry for coupling to the connector shroud 134. For example, the module axis 290 extends through a center of the contact module 200. When the communication system 100 (FIG. 1) is fully assembled, the module axes 290 of the contact modules 200 may extend parallel to each other and to the mating axis 191.

FIG. 4 shows the contact module 200 at 0° rotation. If the contact module 200 were rotated 180° about the module axis 290, the contact module 200 would still be capable of engaging the connector shroud 134 because the shroud-securing features 292, 294 would exchange relative positions. More specifically, the shroud-securing feature 292 has a first spatial position at 0° rotation, and the shroud-securing feature 294 has a second spatial position at 0° rotation. When the contact module 200 is rotated 180° about the module axis 290, the shroud-securing feature 292 is located at the second spatial position and the shroud-securing feature 294 is located at the first spatial position. Accordingly, in either of the rotational positions, the shroud-securing features 292, 294 have the same effective arrangement or configuration for coupling to the connector shroud 134. The configuration of the shroud-securing features 292, 294 may be described as having rotational symmetry about the module axis 290.

Although the contact modules 200 described herein may have a rotational symmetry for coupling to the connector shroud 134, it should be noted that such rotational symmetry does not require all structural features of the contact modules 200 to be symmetrical. For example, the module edge 214 may have structural features therealong that have no effect on whether the connector shroud 134 is capable of coupling to the contact module 200. As such, rotational symmetry refers only to the features that actively hold the components together, such as the shroud-engaging features 292, 294.

Also shown in FIG. 4, the side surface 227 includes a plurality of reference elements 246 and a plurality of reference elements 248. In the illustrated embodiment, the reference elements 246 are distributed along and proximate to the mating edge 211. Like the reference elements 242, 244 (FIG. 3), the reference elements 246, 248 may be physical features of the module body 202, such as projections or recesses. The reference elements 242, 244 are configured to facilitate holding the housing shells 224, 226 together. However, the reference elements 246, 248 may be sized and shaped to complement the reference elements 242, 244, respectively, so that adjacent contact modules 200 may be pressed together. For example, the reference elements 242, 244 may be projections and the reference elements 246, 248 may be recesses that are sized and shaped to receive the reference elements 242, 244, respectively. The reference elements 242, 244, 246, and 248 are configured to orient the contact modules 200 when adjacent contact modules 200 are stacked side-by-side. For example, the reference elements 242 are inserted into the reference elements 246, and the reference elements 244 are inserted into the reference elements 248. In some cases, the reference elements 242, 246 and/or the reference elements 244, 248 may engage each other to form an interference fit that operates to prevent the contact modules 200 from being inadvertently separated.

FIG. 5 is a front-end view of the module assembly 132 including the contact modules 200A-200H stacked side-by-side. In the stacked arrangement, the side surface 225 (FIG. 3) of one contact module interfaces with the side surface 227 (FIG. 4) of an adjacent contact module. When the contact modules 200A-200H are arranged as shown in FIG. 5, the mating edges 211 collectively form a shroud-engaging face 236 of the module assembly 132. The signal contacts 206 and the ground contacts 216 of the contact modules 200A-200H collectively form the communication array 139. The signal contacts 206 and the ground contacts 216 may have designated locations or addresses with respect to one another in the communication array 139. The communication array 139 is configured to mate with the contact array 112 (FIG. 1) of the electrical connector 110 (FIG. 1).

The contact modules 200A-200H have alternating rotational positions in FIG. 5 so that each of the mounting sides 138, 140 is collectively formed from a plurality of the mounting edges 212 and a plurality of the non-mounting edges 213. As shown, the mounting sides 138, 140 include the mounting arrays 142, 144, respectively. The communication array 139 is communicatively coupled to each of the mounting arrays 142, 144 through the signal conductors 220A, 220B (FIG. 3) and the ground conductors 222 (FIG. 3). However, the contact densities of the mounting arrays 142, 144 are less than the contact density of the communication array 139. For example, the mounting arrays 142, 144 have approximately equal perimeters or areas that are approximately equal to the perimeter or area of the communication array 139, but the number of signal contacts 208 in each of the mounting arrays 142, 144 is about half the number of signal contacts 206 in the communication array 139. Thus, the contact densities of the mounting arrays 142, 144 are about half the contact density of the communication array 139. In such embodiments, the circuit boards 146, 148 (FIG. 1) may have fewer signal layers than conventional circuit boards because additional signal layers are not necessary for routing.

It should be noted that FIG. 5 illustrates one arrangement of the contact modules 200A-200H. In other embodiments, the contact modules 200A-200H may have different rotational positions. For example, the contact modules 200A-200D may have a first rotational position, and the contact modules 200E-200H may have a second rotational position. As yet another example, the contact modules 200A, 200D, 200E, and 200H may have a first rotational position, and the contact modules 200B, 200C, 200F, and 200G may have a second rotational position. In the above examples, the number of contact modules 200 in a first rotational position is equal to the number of contact modules in a second rotational position. In other embodiments, however, the numbers may be unequal. For example, the contact modules 200A-200C and 200E-200H may have a first rotational position, and the contact modules 200D and 200E may have a second rotational position. Accordingly, various arrangements of the contact modules 200A-200H may be configured.

Figure 6:
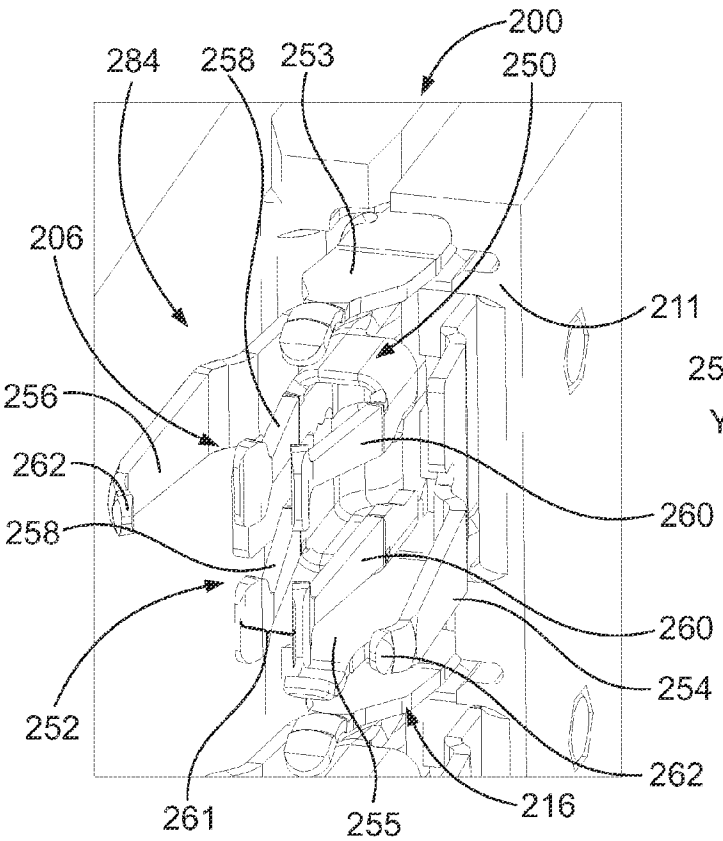
FIG. 6 is an enlarged perspective view of signal contacts and ground contacts that may be used with the electrical connector of FIG. 2.

FIG. 6 is an enlarged perspective view of a portion of the mating edge 211 of the contact module 200 and illustrates a pair of the signal contacts 206 and a set of the ground contacts 216 in greater detail. The pair of signal contacts 206 and the set of the ground contacts 216 shown in FIG. 6 may constitute a single contact sub-array 284. The pair of signal contacts 206 may also be referred to as a signal pair. As shown, the ground contacts 216 of a single contact sub-array 284 are distributed around the pair of signal contacts 206.

For clarity, the signal contacts 206 are referenced individually as signal contacts 250, 252 and the ground contacts 216 are referenced individually as ground contacts 253-256. As shown in FIG. 6, each of the signal contacts 250, 252 includes a pair of contact beams 258, 260. In an exemplary embodiment, the contact beams 258, 260 of one signal contact are stamped and formed from a common piece of sheet metal. The contact beams 258, 260 are shaped to face each other with a contact-receiving space 261 therebetween. As shown, the signal contacts 250, 252 are positioned adjacent to each other without any ground contacts positioned therebetween. In certain embodiments, the signal contacts 250, 252 are capable of transmitting differential signals through the contact module 200.

Also shown in FIG. 6, the ground contacts 253, 256 are stamped and formed from a common piece of sheet metal, and the ground contacts 254, 255 are stamped and formed from a common piece of sheet metal. In the contact sub-array 284, the ground contacts 253-256 are shaped to collectively surround the signal contacts 250, 252 and electrically isolate or shield the signal contacts 250, 252 from other sources of electromagnetic interference. For example, the signal contacts 250, 252 form differential signal paths that are isolated from other differential signal paths by the set of ground contacts 253-256. In particular embodiments, the ground contacts 253, 256 are shaped relative to each other to partially surround the signal contact 250, and the ground contacts 254, 255 are shaped relative to each other to partially surround the signal contact 252.

In some embodiments, each of the ground contacts 253-256 may be an elongated beam. Like the contact beams 258, 260, the ground contacts 253-256 may be configured to engage a corresponding contact of the electrical connector 110 (FIG. 1) and be deflected to a different position. The ground contacts 253-256 are configured to be deflected in inward directions toward the signal contact 250 or the signal contact 252. The ground contacts 253-256 include distal ends 262. In some embodiments, the distal ends 262 are curved inward.

Figure 7:
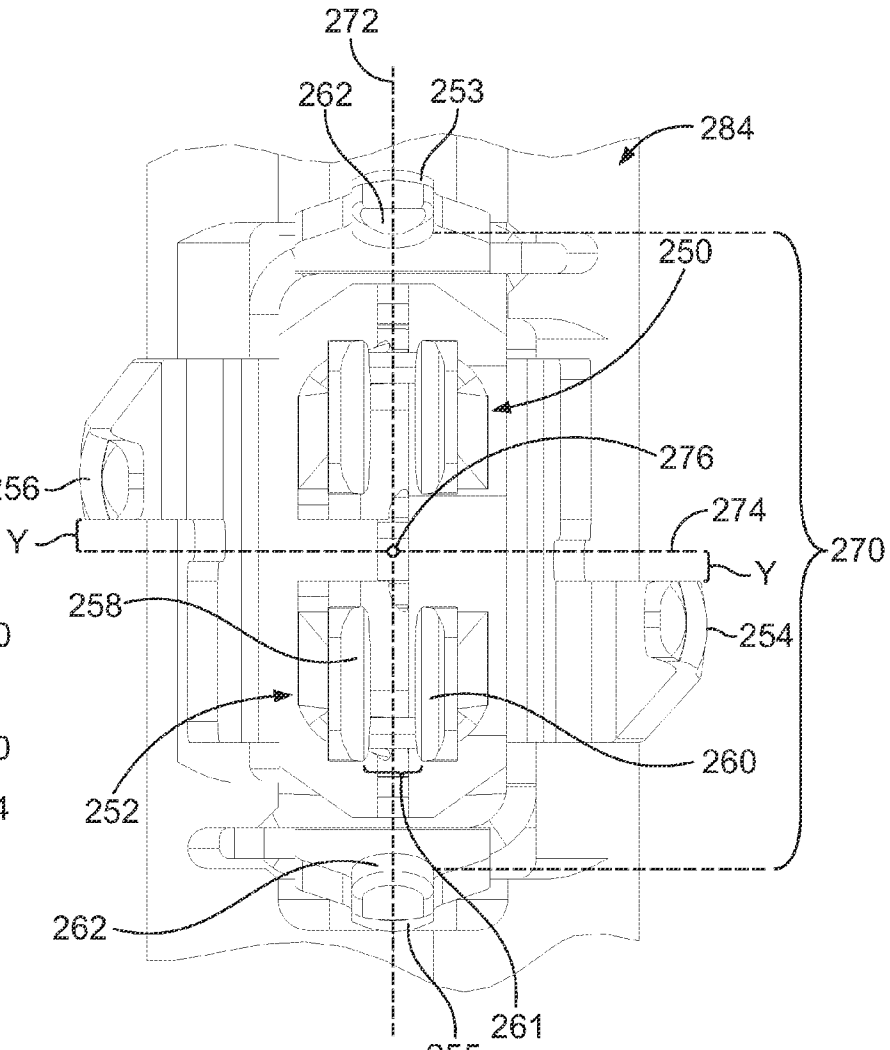
FIG. 7 is an enlarged front-end view of the signal contacts and the ground contacts that may be used with the electrical connector of FIG. 2.

FIG. 7 is a plan view of the signal contacts 250, 252 and the ground contacts 253-256. As shown, the ground contacts 253-256 surround a signal zone or space 270 with the signal contacts 250, 252 located therein. The signal zone 270 is defined between the ground contacts 253, 255 and between the ground contacts 254, 256. As set forth herein, the ground contacts 253-256 and the signal contacts 250, 252 may be positioned relative to one another to have a rotational symmetry between first and second rotational positions. For example, an operative configuration of the ground contacts 253-256 and the signal contacts 250, 252 may be substantially identical in the first and second rotational positions. In particular embodiments, the first and second rotational positions differ by about 180°.

As shown, cross planes 272, 274 extend perpendicular to and intersect each other at a geometric center line 276 of the signal zone 270. More specifically, the ground contact 253 and the ground contact 255 may be aligned along the cross plane 272. For each of the ground contacts 253, 255, the cross plane 272 may intersect a center portion of the distal end 262. The signal contacts 250, 252 are also substantially aligned along the cross plane 272. For each of the signal contacts 250, 252, the cross plane 272 may extend between the opposing contact beams 258, 260 through a center of the contact-receiving space 261.

Also shown, the cross plane 274 may divide the signal zone 270 such that the ground contacts 253, 256 and the signal contact 250 are on one side of the cross plane 274 and the ground contacts 254, 255 and the signal contact 252 are on the other side of the cross plane 274. In the illustrated embodiment, each of the ground contacts 254, 256 is offset from the cross plane 274 by a common distance Y. However, the ground contact 254 is spaced apart from the cross plane 274 in one direction, and the ground contact 256 is spaced apart from the cross plane 274 in an opposite direction.

In some embodiments, the contact sub-array 284 may present an identical operative configuration or arrangement before and after the contact module 200 is rotated between the first and second rotational positions. More specifically, after rotation, the ground contacts 253 and 255 have exchanged positions, and the ground contacts 254 and 256 have exchanged positions. After rotation, the signal contacts 250, 252 have exchanged positions. Effectively, the operative configuration or arrangement of the ground contacts 253-256 and the signal contacts 250, 252 in the first rotational position is the same as the operative configuration or arrangement of the ground contacts 253-256 and the signal contacts 250, 252 in the second rotational position. However, in the illustrated embodiment, it is understood that the contact sub-array 284 will engage a different portion of the electrical connector 110 (FIG. 1) after the contact module 200 (FIG. 1) is rotated.

Figure 8:
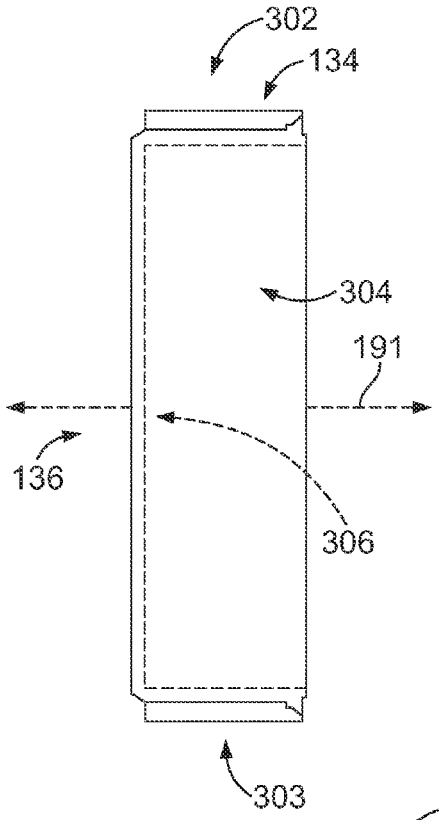
FIG. 8 is a side view of a connector shroud that may be used with the electrical connector of FIG. 2.

FIG. 8 is a side view of the connector shroud 134. In an exemplary embodiment, the connector shroud 134 is capable of coupling with the contact modules 200 when the contact module 200 is in either of the rotational positions described herein. Such embodiments may enable manufacturers to assemble or reconfigure electrical connectors as desired. In other embodiments, however, the connector shroud may be shaped to receive the contact modules only when each contact module is in a designated rotational position, which may or may not be the same rotational position as other contact modules.

With respect to FIG. 8, the connector shroud 134 has the mating side 136, coupling walls 302, 303, and an exterior wall 304. Although not shown, the connector shroud 134 may include another exterior wall that is opposite the exterior wall 304. The mating side 136 is configured to be received by the connector-receiving space 126 (FIG. 1) of the electrical connector 110 (FIG. 1). Also shown by the dashed or phantom lines in FIG. 8, the connector shroud 134 includes a loading side or face 306 that is opposite the mating side 136. The mating axis 191 (FIG. 1) extends through the connector shroud 134 between the mating and loading sides 136, 306. The loading side 306 is configured to interface with the communication array 139 (FIG. 5) when the electrical connector 130 (FIG. 1) is assembled. The loading side 306 also interfaces with the mating edges 211 (FIG. 3) and the shroud-engaging face 236 (FIG. 5) of the module assembly 132.

Figure 9:
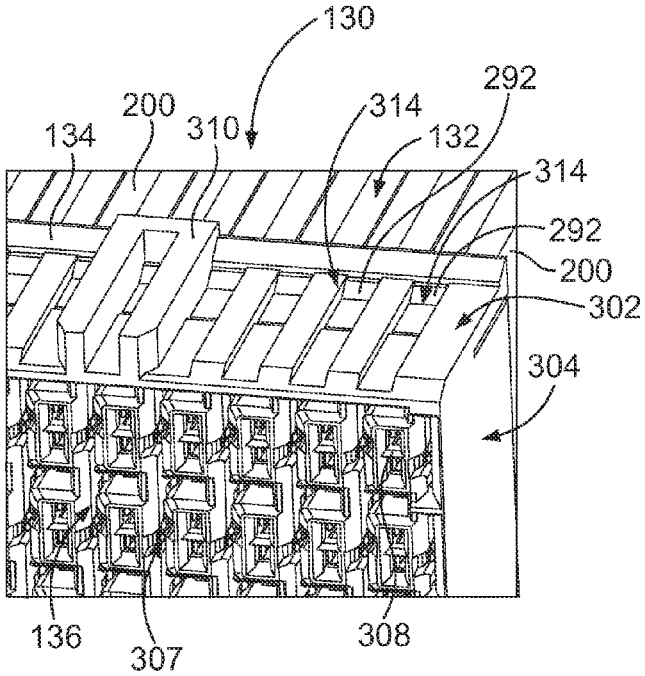
FIG. 9 is an enlarged front portion of the electrical connector of FIG. 2.

FIG. 9 shows an enlarged portion of the electrical connector 130 and, in particular, the module assembly 132, the mating side 136, the coupling wall 302, and the exterior wall 304 of the connector shroud 134. As shown, the mating side 136 includes a passage array 307 of contact passages 308. Each of the contact passages 308 extends between the mating side 136 and the loading side 306 (FIG. 8). The contact passages 308 align with and are configured to provide access to the signal and ground contacts 206, 216 (FIG. 3) of the communication array 139 (FIG. 5).

The coupling wall 302 may include keying features 310 that facilitate properly orienting the electrical connector 130 during a mating operation and aligning the connector shroud 134 with the electrical connector 110 (FIG. 1). In particular embodiments, the coupling wall 302 includes module-securing features 314, which define openings through the coupling wall 302 in the illustrated embodiment. The module-securing features 314 are configured to engage the shroud-securing features 292 to attach the connector shroud 134 to the module assembly 132. Although the coupling wall 303 is not shown, the coupling wall 303 may have identical features as the coupling wall 302.

As described herein, module-securing and shroud-securing features (or attachment features) include physically-defined structures that directly engage other physically-defined structures in order to attach two components. For example, in the illustrated embodiment, the module-securing features 314 include surfaces that define openings or recesses for receiving the shroud-securing features 292 of the contact module 200. However, in other embodiments, the contact module 200 may include openings or recesses for receiving corresponding projections of the connector shroud 134. In alternative embodiments, either of the module-securing and shroud-securing features may be latches that directly engage surfaces of the other component. When the connector shroud 134 and the module assembly 132 are attached to each other, the module-securing features and the shroud-securing features may prevent movement of the module assembly 132 away from the connector shroud 134.

Figure 10:
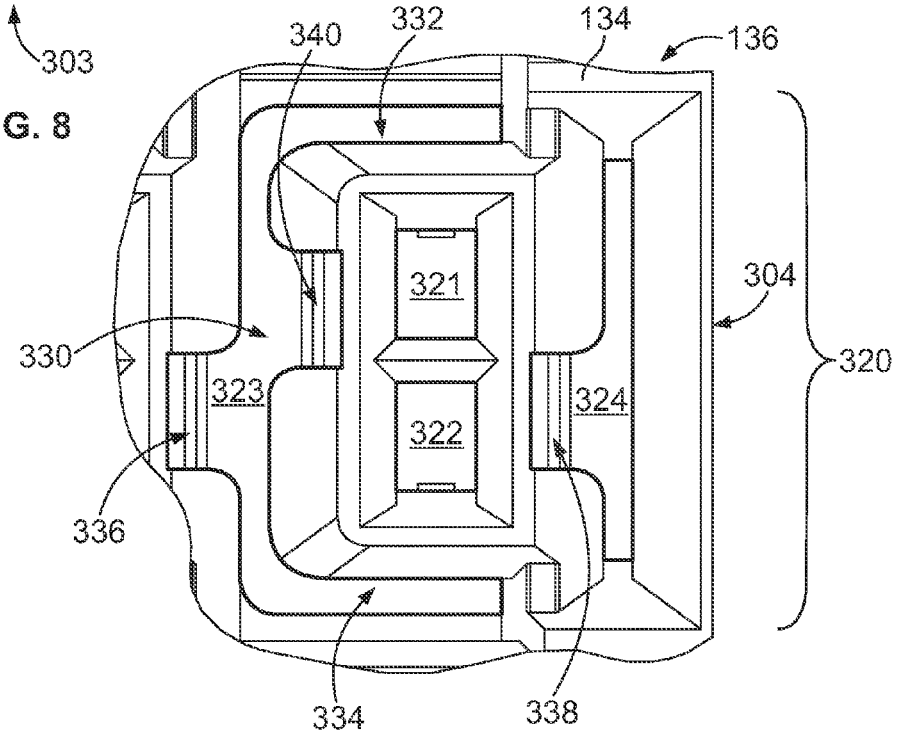
FIG. 10 is an enlarged front-end view of contact passages through the connector shroud.

FIG. 10 is an enlarged view of the mating side 136 of the connector shroud 134 illustrating a passage sub-array or set 320 of contact passages 321-324. The passage sub-array 320 is dimensioned to align with the contact sub-array 284 (FIG.

6) so that the different contacts of the contact sub-array 284 may be engaged during the mating operation. For illustrative purposes, the contact passages 321-324 are outlined in bold in FIG. 10. The contact passages 321-324 extend between the mating side 136 and the loading side 306 (FIG. 8). The portion of the mating side 136 shown in FIG. 10 includes the exterior wall 304. In an exemplary embodiment, the mating side 136 includes a total of eight sub-arrays along the exterior wall 304 that are similar or identical to the sub-array 320. In addition to the sub-arrays 320, the passage array 307 (FIG. 9) may also include other sub-arrays. For example, such sub-arrays may have contact passages that are similar to the contact passages 321-323, but not the contact passage 324.

The contact passages 321-324 include signal passages 321, 322 and ground passages 323, 324. The signal passages 321, 322 are centrally located within the sub-array 320. The ground passages 323, 324 substantially surround the signal passages 321, 322. For example, the ground passage 323 may be C-shaped and include a body portion 330, a leg portion 332, and a leg portion 334. The body portion 330 extends between and joins the leg portions 332, 334. The leg portions 332, 334 extend substantially parallel to each other. As such, the ground passage 323 partially surrounds the signal passages 321, 322. The ground passage 324 is substantially planar and extends parallel to the body portion 330 with the signal passages 321, 322 between. Accordingly, the ground passage 324 and the ground passage 323 substantially surround the signal passages 321, 322.

Also shown in FIG. 10, the ground passage 323 includes recesses 336, 340, and the ground passage 324 includes a recess 338. The recesses 338 and 340 extend generally toward the signal passages 321, 322. The recess 336 extends away from the signal passages 321, 322. Although not shown, the recess 336 may extend toward signal passages of an adjacent sub-array of contact passages.

Figure 11:
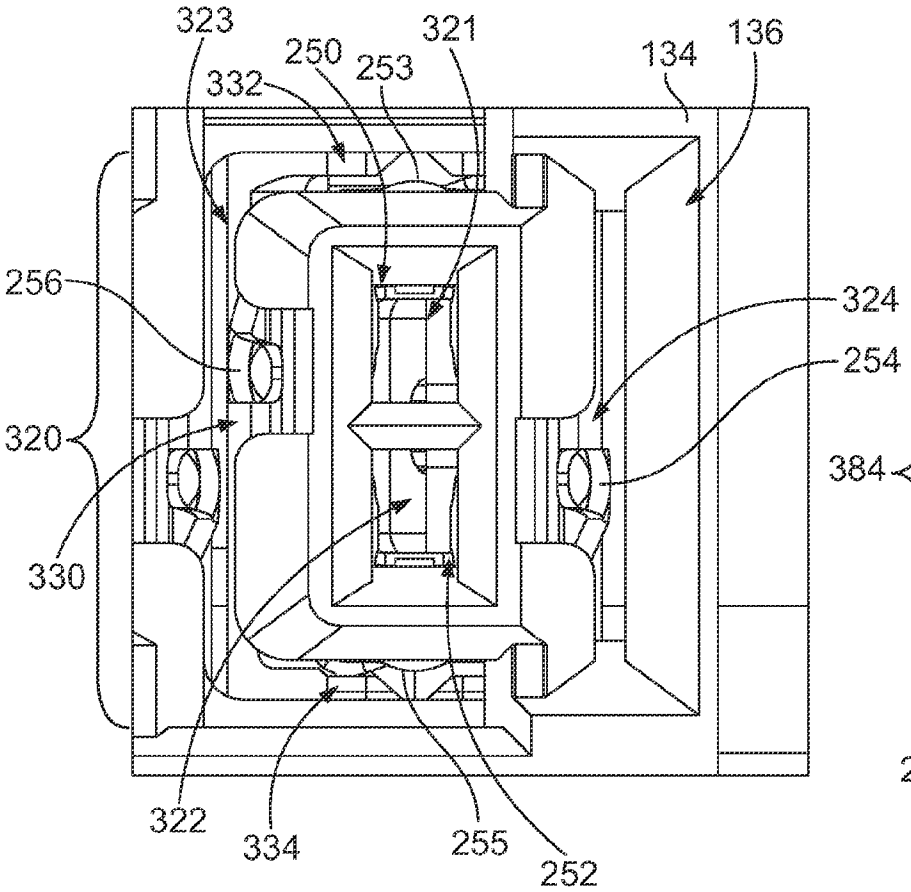
FIG. 11 is an enlarged view of the contact passages aligned with the signal contacts and the ground contacts in accordance with one embodiment.

FIG. 11 is an enlarged view of a portion of the mating side 136 illustrating the signal contacts 250, 252 and the ground contacts 253-256 with respect to the passage sub-array 320. In FIG. 11, the signal contacts 250, 252 and the ground contacts 253-256 are located behind the connector shroud 134. As shown in FIG. 11, the signal contacts and the ground contacts are aligned with corresponding contact passages so that the signal and ground contacts will be engaged when the electrical connectors 110, 130 (FIG. 1) are mated. More specifically, the ground contact 253 is aligned with the leg portion 332 of the ground passage 323; the ground contact 254 is aligned with the ground passage 324; the ground contact 255 is aligned with the leg portion 334 of the ground passage 323; and the ground contact 256 is aligned with the body portion 330 of the ground passage 323. The signal contacts 250, 252 are aligned with the signal passages 321, 322, respectively.

Figure 12:
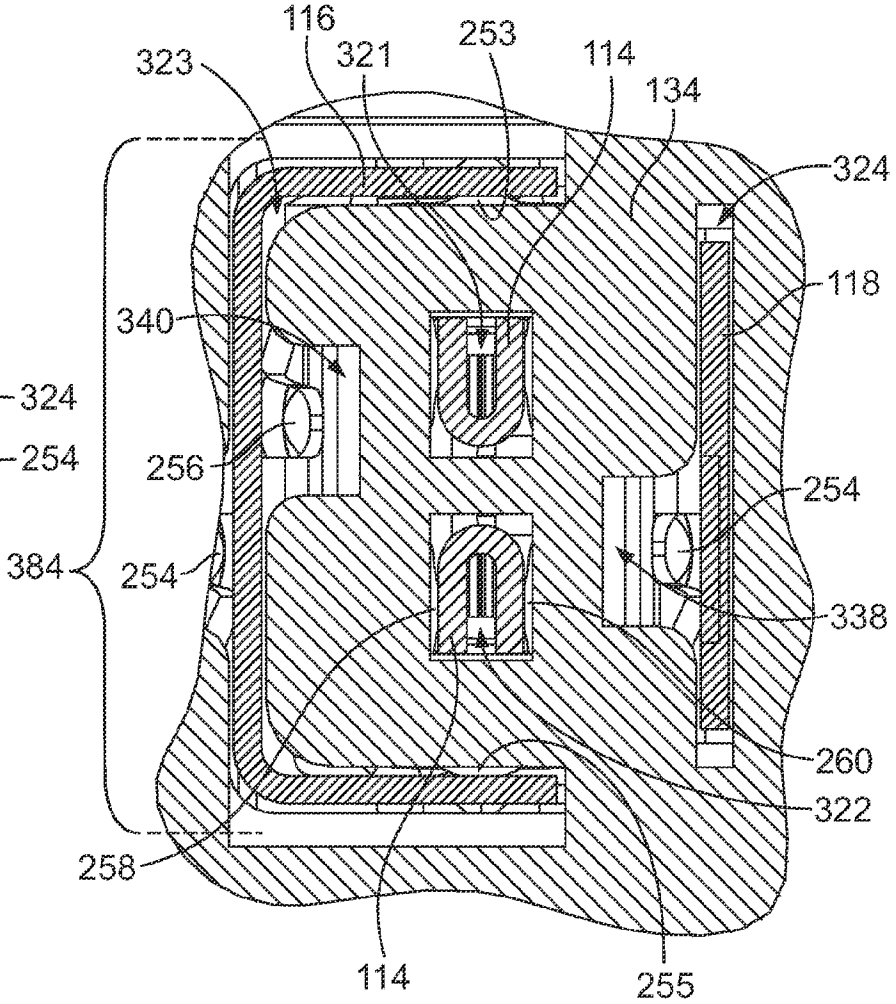
FIG. 12 is a cross-section of the electrical connector illustrating the signal contacts and the ground contacts engaged to corresponding features of a mating connector.

FIG. 12 is a cross-section of a portion of the connector shroud 134 taken transverse to the mating axis 191 (FIG. 1) when the electrical connector 110 (FIG. 1) and the electrical connector 130 (FIG. 1) are mated. As shown, a ground contact 116 of the electrical connector 110 has been inserted into the ground passage 323 and one of the ground shields 118 has been inserted into the ground passage 324. Respective signal contacts 114 of the electrical connector 110 have been inserted into the signal passages 321, 322. During the mating operation, the electrical connector 130 is advanced toward the electrical connector 110 along the mating axis 191. As the ground contact 116 is inserted into the ground passage 323, the ground contact 116 engages each of the ground contacts 253, 255, and 256. As the ground shield 118 is inserted into the ground passage 324, the ground shield 118 engages the ground contact 254. In the illustrated embodiment, the ground contact 116 also engages the ground contact 254 from the adjacent contact sub-array. As shown, the ground contacts 254, 256 are deflected into the recesses 338, 340, respectively.

As the signal contacts 114 are advanced into the corresponding signal passages 321, 322, each of the signal contacts 114 engages the contact beams 258, 260 and deflects the contact beams 258, 260 away from each other. The contact beams 258, 260 may be biased to press against the corresponding signal contact 114 and slide therealong as the signal contact 114 is advanced into the corresponding signal passage 321-322. Likewise, the ground contacts 253-256 may be biased to press against the corresponding ground contact 116 or the ground shield 118 of the electrical connector 110.

The ground contacts 116, the ground shields 118, and the signal contacts 114 of the electrical connector 110 may constitute a header sub-array 384. When the corresponding contact module 200 is in either rotational position, the contact sub-arrays 284 align with corresponding header sub-arrays 384. However, it is noted that the contact sub-arrays 284 may engage different header sub-arrays 384 depending on the rotational position of the contact module 200. Nonetheless, the passage sub-array 320 may permit the mating operation in either rotational position.

Figure 13:
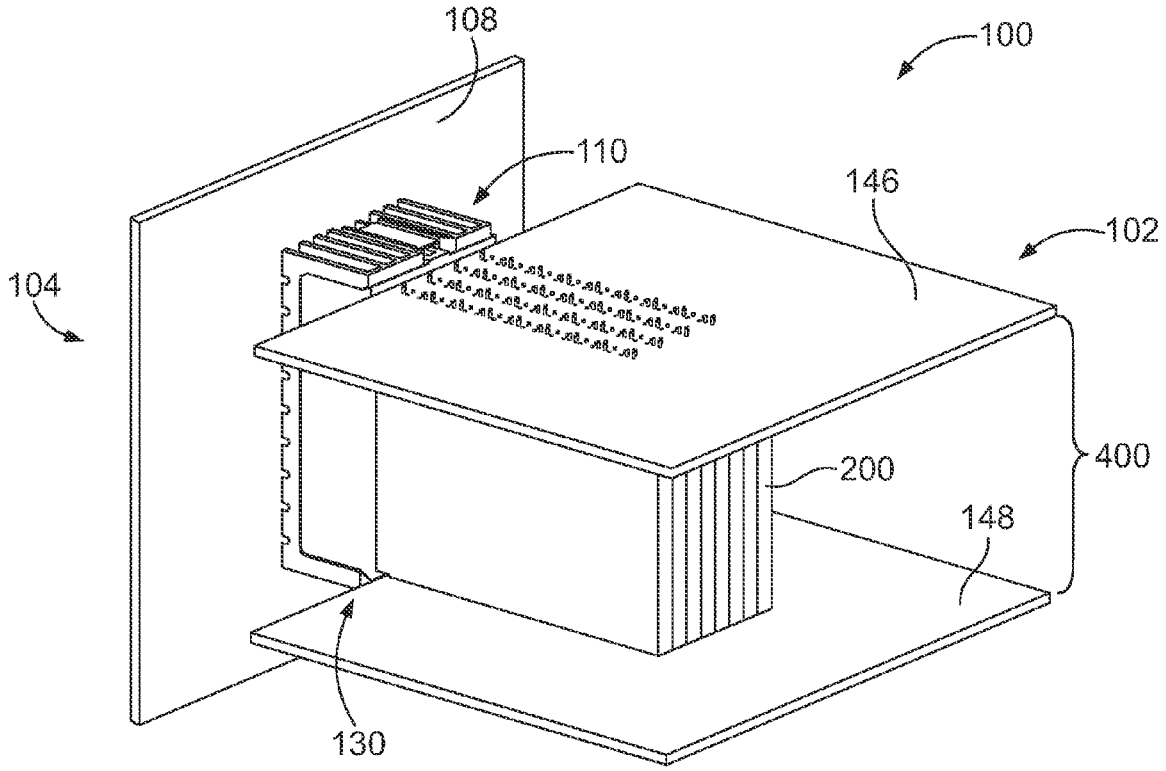
FIG. 13 is a perspective view of the communication system of FIG. 1 fully assembled.

FIG. 13 is a perspective view of the communication system 100 when the circuit board assemblies 102, 104 are mated. As shown, the electrical connector 130 is mounted to each of the circuit boards 146, 148. The circuit boards 146, 148 oppose each other with a spacing 400 therebetween. The electrical connector 130 is located within the spacing 400. When the electrical connectors 110, 130 are mated as shown, the electrical connector 130 is communicatively coupled to each of the circuit boards 146, 148 and also to the circuit board 108. Accordingly, the circuit boards 108, 146, and 148 may be mechanically and communicatively connected by embodiments described herein. Moreover, based on the arrangement of the contact modules 200, the data throughput of the electrical connector 110 may be divided such that different portions of the data throughput are communicated through the circuit boards 146, 148.

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. In addition, in the following claims, the term "plurality" does not include each and every element that an object may have. For example, if the claims recite an electrical contact having "a plurality of contact beams," the plurality of contact beams may not include each and every contact beam that the electrical contact may have. There may be additional contact beams that do not have the features recited in the claims with respect to the plurality. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising a connector body having a mating side that includes a communication array of signal and ground contacts and first and second mounting sides that have respective mounting arrays of signal and ground contacts, each of the first mounting side and the second mounting side configured to be mounted to a corresponding circuit board, the connector body including signal and ground conductors that extend through the connector body and communicatively couple the communication array to each of the mounting arrays, wherein the mating side faces along a mating axis and the first mounting side and the second mounting side face in opposite directions along a mounting axis, the mating axis and the mounting axis being perpendicular to each other, wherein the connector body includes a module assembly having a series of distinct contact modules coupled directly or indirectly to one another, the series of contact modules collectively forming the mating side, the first mounting side, and the second mounting side of the connector body.

2. The electrical connector of claim 1, wherein each of the communication array and the mounting arrays is a two-dimensional array.

3. The electrical connector of claim 1, wherein the series of contact modules include at least three contact modules.

4. The electrical connector of claim 1, wherein each of the contact modules includes a mating edge and a mounting edge that extend perpendicular to each other, the series of contact modules including first and second contact modules, the mounting edge of the first contact module including at least some of the signal contacts and the ground contacts of the mounting array of the first mounting side, the mounting edge of the second contact module including at least some of the signal contacts and the ground contacts of the mounting array of the second mounting side.

5. The electrical connector of claim 4, further comprising a third contact module, the second contact module being positioned between the first and third contact modules, wherein the mounting edge of the third contact module includes at least some of the signal contacts and the ground contacts of the mounting array of the first mounting side.

6. The electrical connector of claim 1, further comprising a connector shroud coupled to the module assembly and interfacing with the communication array.

7. The electrical connector of claim 1, wherein the first mounting side and the second mounting side have substantially equal perimeters.

8. The electrical connector of claim 1, wherein the communication array has at least 12 signal contacts per 100 $mm^2$.

9. The electrical connector of claim 1, further comprising first and second circuit boards, the first mounting side and the second mounting side being mounted to the first circuit board and the second circuit board, respectively.

10. An electrical connector comprising a module assembly including a plurality of discrete contact modules having respective module bodies that are coupled directly or indirectly to one another, each of the module bodies having a mating edge and a mounting edge that extend substantially perpendicular to each other, each of the contact modules having signal contacts disposed along the mating edge and the mounting edge and signal conductors that extend between the mating edge and the mounting edge to join corresponding signal contacts, wherein the mating edges of the contact modules face in a common mating direction such that the signal contacts along the mating edges collectively form a communication array, the mounting edges of at least two of the contact modules facing in opposite mounting directions.

11. The electrical connector of claim 10, further comprising a connector shroud coupled to the module assembly and interfacing with the communication array.

12. The electrical connector of claim 11, wherein the connector shroud includes contact passages that align with corresponding signal contacts of the communication array.

13. The electrical connector of claim 11, wherein each of the contact modules is oriented with respect to a respective central module axis, the mating edge for each of the contact modules facing along the respective module axis, the connector shroud including a plurality of module-securing features, wherein each of the contact modules includes a plurality of shroud-securing features that directly engage corresponding module-securing features of the connector shroud, the shroud-securing features for each of the contact modules having a rotational symmetry such that an operative configuration of the shroud-securing features for each of the contact modules is substantially identical before and after the corresponding contact module is rotated 180° about the corresponding module axis.

14. The electrical connector of claim 13, wherein the shroud-securing features and the module-securing features include projections or openings that are sized to receive corresponding projections.

15. The electrical connector of claim 10, wherein the contact modules include first and second contact modules, the module body of the first contact module having a side surface that includes a reference element and the module body of the second contact module having a side surface that includes a reference element, the reference elements of the first contact module and the second contact module engaging each other to position the first contact module and the second contact module in designated orientations with respect to each other.

16. The electrical connector of claim 10, wherein the contact modules include at least three contact modules in which the module bodies have identical structures.

17. The electrical connector of claim 10, wherein each of the contact modules further comprises ground contacts disposed along the respective mating and mounting edges.

18. The electrical connector of claim 17, wherein the signal contacts for each of the contact modules are arranged to form signal pairs, each of the signal pairs being surrounded by a plurality of the ground contacts.

19. The electrical connector of claim 10, further comprising a circuit board having the electrical connector mounted thereon.

* * * * *